US005867556A

United States Patent [19]

Snyder et al.

[11] Patent Number: 5,867,556

[45] Date of Patent: Feb. 2, 1999

[54] ANODE MOUNTING APPARATUS WITH THERMAL GROWTH COMPENSATION FOR X-RAY TUBE

[75] Inventors: Douglas J. Snyder, Brookfield; Thomas Block, Milwaukee, both of Wis.; Dale G. Chrisien, Florence, S.C.

[73] Assignee: General Electric Company, Milwaukee, Wis.

[21] Appl. No.: 957,056

[22] Filed: Oct. 24, 1997

[51] Int. Cl.[6] ..... H01J 35/28

[52] U.S. Cl. ..... 378/127; 378/126

[58] Field of Search ..... 378/119, 121, 378/126, 125, 127, 136, 137, 138, 143, 144, 113

[56] References Cited

U.S. PATENT DOCUMENTS 4,162,420 7/1979 Grady ..... 378/126

5,742,662 4/1998 Kuhn et al. ..... 378/136 X

*Primary Examiner*—David P. Porta

*Attorney, Agent, or Firm*—James O. Skarsten; Christian G. Cabou; Phyllis Y. Price

[57] ABSTRACT

In an X-ray tube having a housing, an outer frame for providing a vacuum, a cathode mounted in the outer frame to project a stream of electrons, and an anode disposed to receive the electron stream at a focal spot position to produce X-rays, apparatus is provided for selectively mounting the anode within the housing. More particularly, the apparatus is disposed to respond to the heat generated by the X-ray production process to provide compensation for undesirable effects resulting from thermal expansion of the anode. The apparatus generally comprises an anode frame structure disposed to support the anode for rotation about a specified axis, and further comprises an anode plate joined to the frame structure for locating the anode at an initial position, in spaced-apart relationship with the cathode and with the aperture of a collimator in fixed relation to the tube, and for displacing the anode away from the initial position, in a direction opposite to the direction of anode thermal expansion, to provide compensation therefor. A compliant plate mounting arrangement is provided for selectively attaching the anode plate to the housing.

14 Claims, 4 Drawing Sheets

ANODE MOUNTING APPARATUS WITH THERMAL GROWTH COMPENSATION FOR X-RAY TUBE

BACKGROUND OF THE INVENTION

The invention disclosed and claimed herein generally pertains to an arrangement for mounting a rotatable X-ray tube anode which provides compensation for thermal expansion of the anode. More particularly, the invention pertains to an arrangement of such type which compensates for displacement of the anode focal spot with respect to the X-ray tube window and collimator, as a result of the anode thermal expansion. Even more particularly, the invention pertains to such arrangement wherein a portion of the heat causing the anode thermal expansion is employed to provide a counter-displacement of the anode and focal spot, i.e., to urge the anode and focal spot back to the positional relationship between the focal spot and the window and collimator which is required for accurate imaging.

An X-ray tube is the principal component of conventional X-ray equipment and computed tomography (CT) equipment. Such tubes contain a vacuum at $10^{-8}$ to $10^{-9}$ torr, and operate to direct a stream of electrons across very high voltage, such as 100–140KV, from a cathode to a focal spot position on a tungsten anode target. X-rays are produced as electrons strike the tungsten, and are directed toward an X-ray transmissive window or port plate, provided in the tube housing or casing. The X-ray beam passes through the window, and also through the narrow aperture or slit of a collimator spaced apart from the window. The collimated beam is directed through a patient, to provide imaging data at an X-ray detector. However, the conversion efficiencies of such tubes are quite low. Accordingly, considerable heat is generated in the anode as a byproduct of the X-ray generation.

In order to reduce heat concentration in the anode, the tungsten anode target is in the form of an annular track, and the focal spot position is a point along the track. The anode is rotatably mounted on bearings, and rotated at high speeds. By means of such arrangement, the electron stream from the cathode is continuously presented with a new and cooler surface. Nevertheless, in a high performance X-ray tube, the surface of the anode may reach temperatures in excess of 2500° centigrade, and areas of the anode outside the immediate target surface may rise to temperatures in excess of 1000° centigrade. The heating of the anode causes growth or expansion of the anode materials. Such expansion, in turn, results in axial motion of the focal spot, i.e., movement or displacement of the focal spot from its intended or ideal position with respect to the tube axis, the X-ray transmissive window, and most importantly the collimator aperture. The aperture is very narrow, such as less than one millimeter. Thus, even comparatively slight axial shifting of the focal spot causes the X-ray beam to pass through the collimator aperture at a position which is off-set from the correct position therefor. Accordingly, as described hereinafter in further detail, the collimated beam will strike the X-ray detector at an off-set position. This is very undesirable, particularly in a CT system, since it leads to serious image quality problems.

In the past, X-ray tube designs have generally done nothing to compensate for anode thermal growth. In order to correct image quality problems resulting therefrom, it has been necessary to make modifications in other components of the CT system. It is anticipated that future developments in CT will place even stricter constraints on axial movement of the focal spot.

SUMMARY OF THE INVENTION

The present invention is generally directed to apparatus for selectively mounting an X-ray tube anode, wherein the X-ray tube includes a housing provided with an X-ray transmissive window, and also includes a cathode mounted to project a stream of electrons to a focal spot on the anode target, in order to produce X-rays. A collimator having an aperture disposed to receive the X-rays provides a collimated X-ray beam. The anode mounting apparatus comprises an anode frame disposed to support the anode for rotation about a specified axis, and further comprises an anode plate means joined to the anode frame. The anode plate means initially locates the anode so that the focal spot is at a specified position with respect to the window and aperture. The specified position is selected to direct the X-rays produced by the tube to the collimator so that the direction of the collimated beam will result in accurate imaging. The anode plate means also functions to displace the anode following thermal expansion thereof, along the axis to urge the focal spot back to the specified position. The anode is displaced in corresponding relationship to an amount of heat which is radiated to the anode plate means from the anode, and comprises a portion of the heat causing the thermal expansion of the anode. The anode mounting apparatus further includes a plate mounting means, for selectively attaching the anode plate means to the housing.

In a preferred embodiment, the anode plate means comprises an annular anode plate comprising inner and outer annular plate components which are joined together. Also, both plate components may have the same outer diameters so that their respective outer edges are in aligned relationship, although the invention is by no means limited thereto. The inner and outer plate components each have a thickness dimension measured along the specified axis, wherein the thickness of the outer plate component is selectively greater than the thickness of the inner plate component. As a result, the inner plate component flexes in the direction required to urge the focal spot back to its specified position, with respect to the aperture, when heat is radiated to the annular anode plate from the anode. The plate mounting means comprises means for supporting the annular anode plate so that the centroids of the inner and outer plate components are respectively located on the specified axis, in spaced-apart relationship with one another.

In one embodiment of the invention, the outer plate component is formed of a first material having a comparatively low coefficient of thermal expansion, such as Kovar, and the inner plate component is formed of a second material having a comparatively high coefficient of thermal expansion, such as copper or stainless steel. In another embodiment of the invention, the outer and inner plate components comprise a single, integral structure.

OBJECTS OF THE INVENTION

An object of the invention is to provide compensation for certain effects caused by thermal expansion of an X-ray tube anode, such an axial displacement of the target focal spot from the position thereof which is required for accurate imaging.

Another object is to provide such compensation by means of an arrangement which urges the anode and focal spot in an axial direction, which is opposite to the direction thereof resulting from undesired thermal expansion of the anode.

Another object is to provide an arrangement of the above type which is comparatively simple and inexpensive, and will only provide focal spot displacement compensation if such compensation is actually needed.

Another object is to provide an arrangement of the above type, wherein the arrangement is made operative to provide compensation by means of the same heat which causes the anode to thermally expand.

These and other objects and advantages of the invention will become more readily apparent from the following description, taken together with the accompanying drawings.

DETAILED DESCRIPTION OF THE PREFERRED EMBODIMENT

Figure 1:
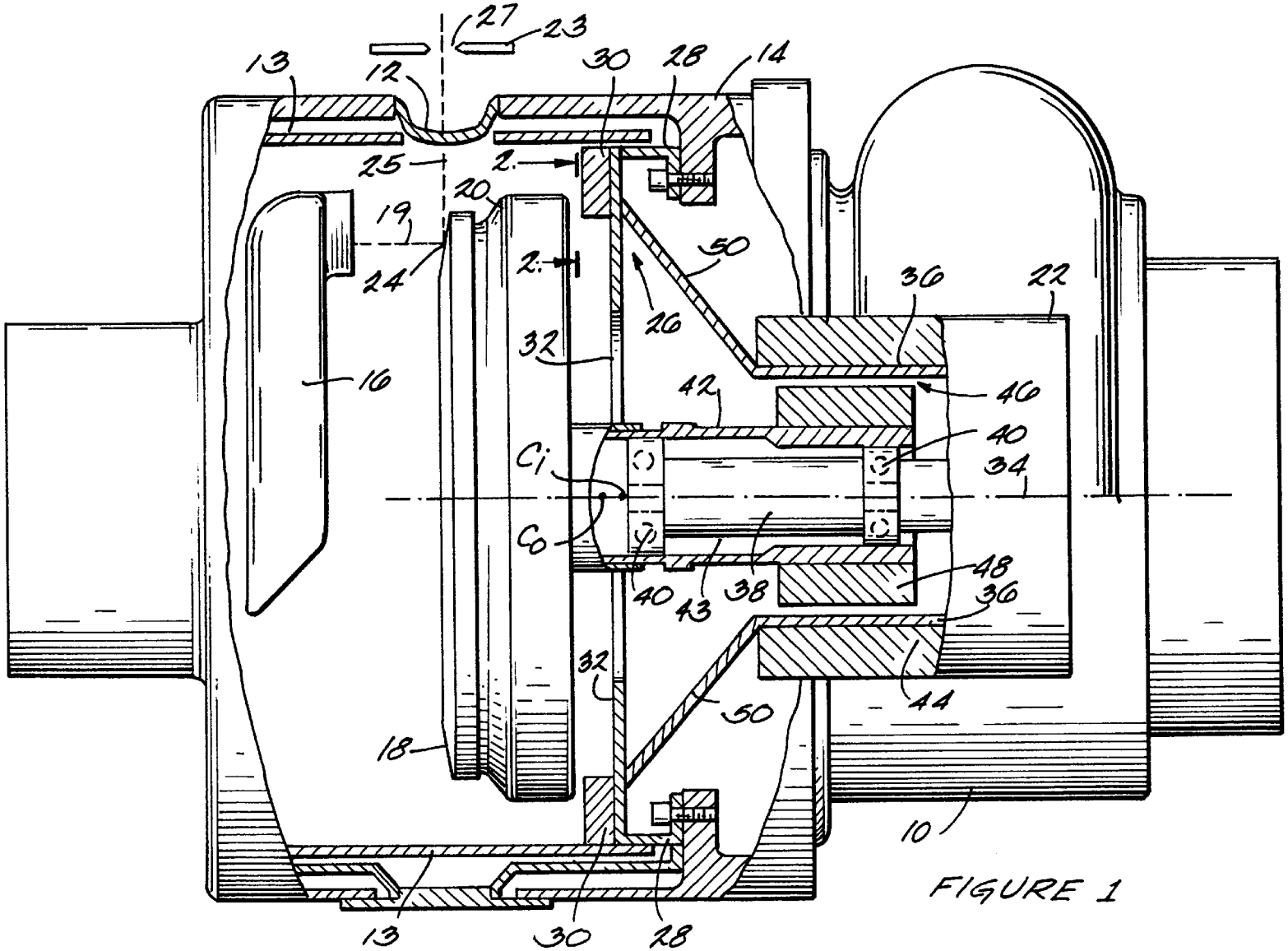
FIG. 1 is a perspective view with a section broken away, showing an X-ray tube provided with an embodiment of the invention.

Referring to FIG. 1, there is shown an X-ray tube 10 which includes an embodiment of the invention, as hereinafter described. In accordance with conventional practice, tube 10 generally includes a metal housing 14, which protectively encloses and supports other X-ray tube components, including a frame 13. The frame 13 provides a vacuum enclosure for the respective components of tube 10, including a cathode 16 which is fixably mounted to the frame 13. Cathode 16 directs a stream of electrons 19 onto a track 18 of an anode 20, which is continually rotated by means of an anode mounting and drive mechanism 22, described hereinafter. Track 18 has an annular or ring-shaped configuration. As anode 20 rotates, the stream of electrons from cathode 16 impinges upon a continually changing portion of track 18 to generate X-rays. The electrons strike the target 18 at a focal spot which ideally remains at a position 24, relative to a collimator 23 having a fixed spaced-apart relationship with tube 10, as the anode target rotates. A beam of X-rays 25 is thereby generated, which is projected from the anode focal spot through an X-ray transmissive window 12, provided in the side of housing 14 and frame 13. The beam 25 also passes through collimator aperture 27, whereby the beam is collimated before passing through a patient, to an associated detector (not shown in FIG. 1). As long as the focal spot is at position 24, beam 25 will be directed accurately, with respect to window 12 and aperture 27, as well as to the associated X-ray detector. The effects of axially shifting the focal spot from position 24 are described hereinafter in further detail, in connection with FIG. 5.

Referring further to FIG. 1, there is shown an annular anode plate 26 positioned on the opposite side of anode 20 from the cathode 16, in spaced-apart relationship. Anode plate 26 is attached to housing 14 by means of mounting members 28, which comprise members of comparatively thin cross-section formed of material such as stainless steel. Accordingly, mounting members 28 are compliant, i.e., they can flex or bend slightly. Members 28 may comprise, for example, lugs distributed around the outer circumference of anode plate 26.

Figure 2:
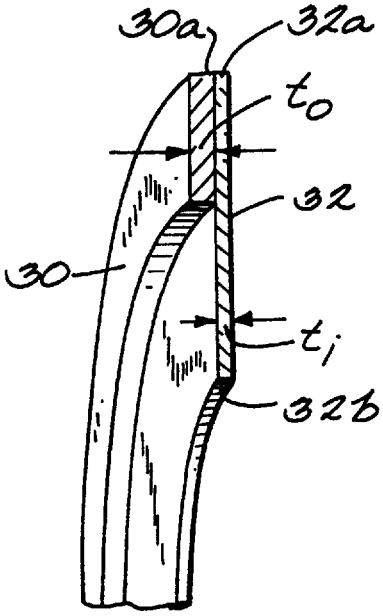
FIG. 2 is a view taken along lines 2—2 of FIG. 1 showing an anode plate for the embodiment of FIG. 1.

FIG. 1 further shows anode plate 26 comprising two annular components, i.e. an outer plate component 30 and an inner plate component 32, which are joined together along mutually abutting surfaces. In the embodiment of FIG. 1, both annular plate components have the same outer diameter, and are joined so that their respective outer edges 30*a* and 32*a* are aligned with one another, as best shown by FIG. 2. However, the inner diameter of the inner plate component 32 is substantially less than the inner diameter of the outer plate component 30. Moreover, the thickness $t_o$ of outer plate component 30 is substantially greater than the thickness $t_i$ of inner plate component 32, where thickness dimensions $t_o$ and $t_i$ are respectively measured along the axis 34 of X-ray tube 10. Preferably, thickness $t_o$ is at least three times greater than $t_i$, although other ratios can be used as well. FIG. 1 shows $C_o$ and $C_i$, the respective centroids or centers of mass of outer and inner plate components 30 and 32 to both lie on axis 34. The centroid $C_o$ is closer to cathode 16 than centroid $C_i$. Also, for reasons set forth hereinafter, outer plate component 30 is formed of material having a low coefficient of thermal expansion (CTE), such as Kovar, and inner plate component 32 is formed of material having a high CTE, such as copper. It is to be understood that in other embodiments of the invention, such as set forth hereafter in connection with FIG. 6, the outer edges of the plate components need not be aligned, and their outer diameters need not be the same.

Referring further to FIG. 1, there is shown anode mounting and drive mechanism 22 provided with a frame 36, which includes a bearing support member 38 carrying a set of rotary bearings 40. Anode 20 is provided with a shaft 42 having a recess 43 sized to receive member 38 and bearings 40, so that anode shaft 42 and anode 20 are rotatably supported thereby. To rotatably drive the anode, stator windings 44 of an induction motor 46 are mounted on frame 36, and the rotor 48 of the motor is mounted on anode shaft 42. Thus, when electrical power is applied to the stator windings through a suitable power transmission path (not shown), motor 46 operates, in conventional manner, to rotatably drive rotor 48 and thereby anode shaft 42 and anode 20.

Referring once more to FIG. 1, there is shown anode mounting and drive mechanism 22 supported within housing 14 by means of a conical shaped support member 50. More particularly, the smaller end of conical member 50 is joined to frame 36, and the larger end is joined to inner plate component 32. Member 50 and anode plate 26 are respectively positioned so that they are in coaxial relationship with each other, and so that their respective axes are aligned along the tube axis 34. In another embodiment structure 50 could be cylindrical or other shape rather than conical.

Figure 3:
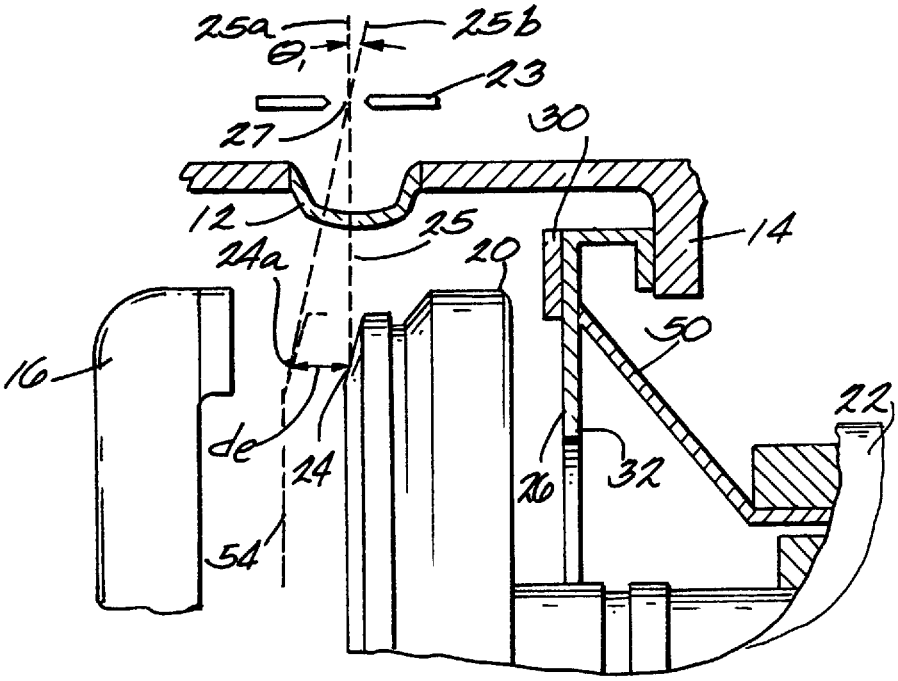
FIGS. 3 and 4 are views showing, in greater detail, portions of structure shown in FIG. 1 to illustrate the operation of the embodiment shown in FIG. 1.

It is thus seen that anode 20 is mounted for rotation within housing 14 by means of an arrangement comprising annular plate 26, the plate mounting members 28, and structure which includes the conical member 50 and anode support frame 36. Respective components of such arrangement are configured so that the rotary axis of anode 20 is aligned along tube axis 34. Moreover, such components cooperate to position anode 20 along the axis 34 so that the focal spot is at position 24 in the absence of any thermal deformation of anode 20. When the focal spot is at such position, the X-ray beam 25 passes through collimator aperture 27 to provide a collimated beam 25*a*, as shown in FIG. 3. Beam 25*a* has the direction or orientation desired for accurate imaging. However, as stated above, a substantial amount of heat is applied to the anode when electrons are directed to the focal spot. Such heat causes the anode to expand, to a position represented in FIG. 3 by dashed line 54. Accordingly, the focal spot 24 is moved toward cathode 16 by displacement $d_e$, to a position 24*a* as shown in FIG. 3. The X-ray beam is also shifted, so that it passes through aperture 27 to produce a collimated beam 25*b*. The direction of beam 25*b* is off-set by an angle $\theta_1$ from the desired direction of collimate beam 25*a*.

Figure 5:
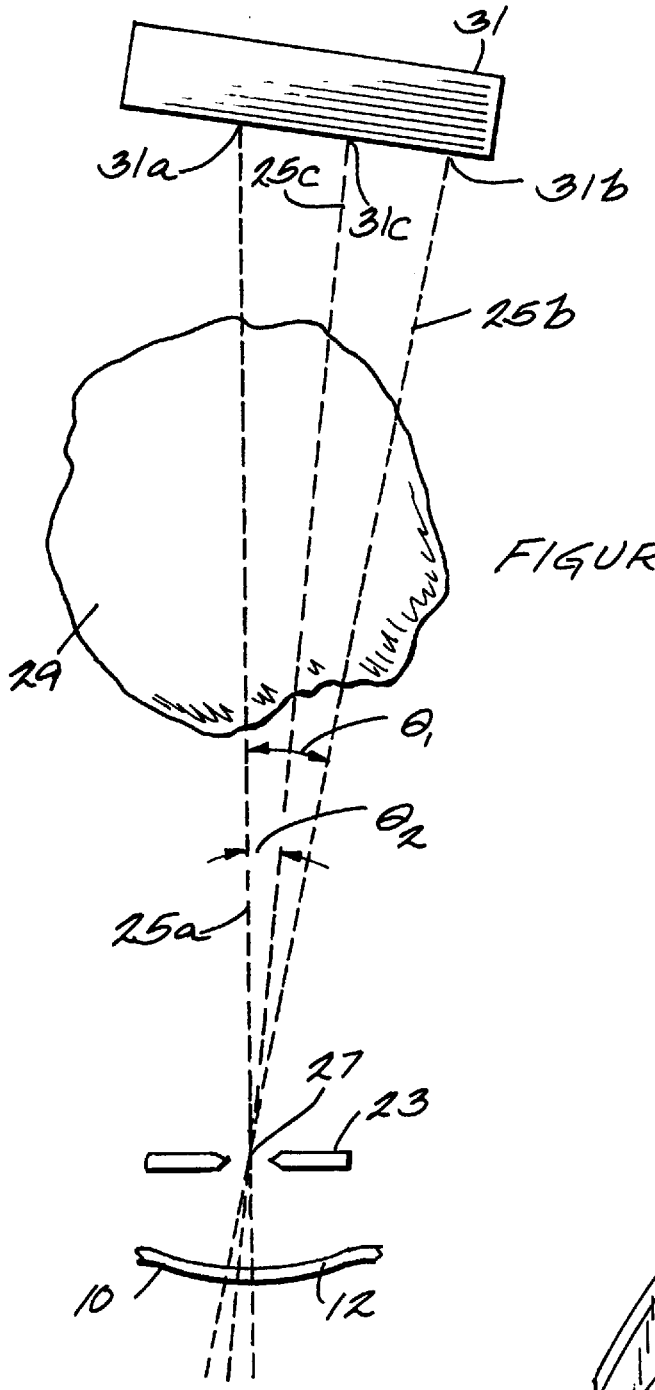
FIG. 5 is a schematic view illustrating effects resulting from shift of the anode focal spot.

Referring to FIG. 5, there is shown collimated X-ray beam 25*a*, from aperture 27 of collimator 23, projected through a patient 29 to an X-ray detector 31, comprising the detector of a conventional CT system (not shown). More specifically, beam 25*a* intersects detector 31 at a point 31*a*. Intersection must occur at such point, in order for the detector to provide an accurate image of a particular desired section taken through the patient 29.

Referring further to FIG. 5, there is shown collimated beam 25*b* intersecting the detector 31 at a point 31*b*. It is to be kept in mind that in a CT system the X-ray tube 10 and collimator 23 are typically mounted on a gantry ring (not shown) in opposing relationship with the detector 31, so that the patient 29 is positioned therebetween. Accordingly, there is a substantial distance between the collimator 23 and detector 31. Thus, even a comparatively small angular offset $\theta_1$, resulting from axial displacement of the focal spot as described above, causes significant displacement of the collimated beam from its proper intersection point 31*a*.

Figure 4:
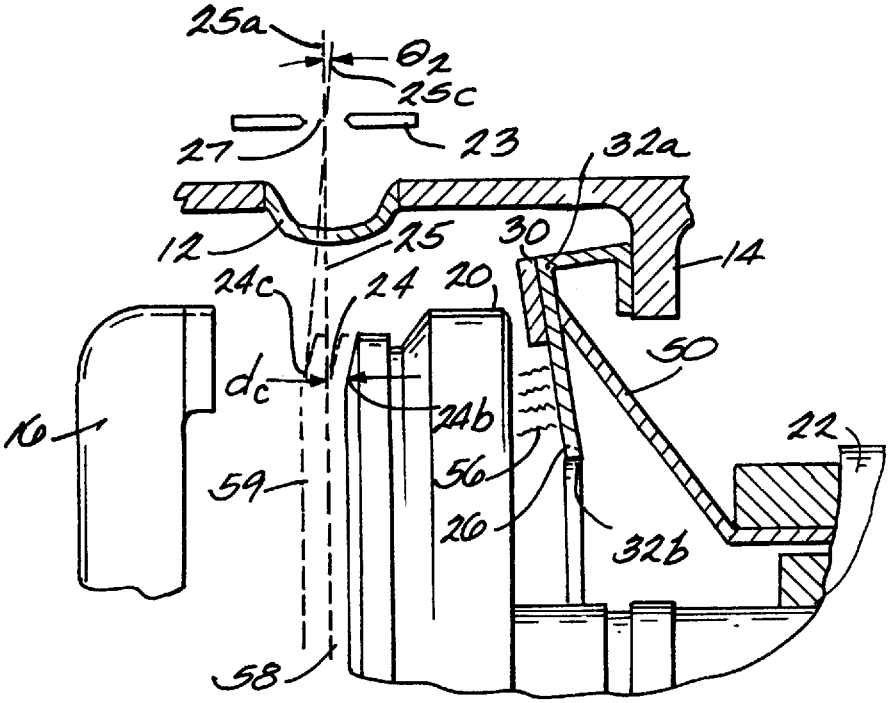

Referring to FIG. 4, there is shown the operation of the anode mounting arrangement, and particularly of anode plate 26, in providing compensation for the above thermal expansion of anode 20. As the anode is heated during X-ray generation, a portion of the heat 56 is radiated from the anode to the anode plate 26. In response to the heat, inner plate component 32 will tend to flex, due to its high CTE and comparatively thin cross section $t_i$. Since the outer edge 32*a* of inner plate component 32 is attached to mounting members 28, whereas the inner edge 32*b* of inner plate component 32 is unconstrained, such flexure results in movement of inner edge 32*b*. Moreover, by providing outer plate component 30 with thickness $t_o$, and low CTE, as described above, and by positioning outer plate component 30 around the outer edge of inner plate component 32, on the side thereof facing cathode 16, inner plate component 32 is effectively constrained against flexure toward the cathode, and in the direction of thermal expansion shown in FIG. 3. Instead, its inner edge 32*b* must flex in the opposite direction, as shown by FIG. 4. Since conical member 50, anode support structure 22, and anode 20 are respectively carried upon inner plate component 32, the flexure thereof likewise displaces them in such opposite direction, i.e., to the right as viewed in FIG. 4, and away from the initial anode position represented by line 58. Accordingly, the focal spot is displaced away from position 24, by a distance represented in FIG. 4 as $d_c$, to position 24*b*. It will be seen that the displacement $d_c$, resulting from the same heating effect which causes the displacement $d_e$, directly off-sets or compensates for such displacement $d_e$. The cumulative displacement is (de-dc), which causes the anode to be actually located at a position represented by the line 59, and the focal spot to be actually located at a position represented by 24*c*. The X-ray beam, passing through the collimator aperture 27 from focal spot position 24*c*, produces a collimator beam 25*c*. The angular off-set $\theta_2$, between collimated beams 25*a* and 25*c*, is much less than $\theta_1$.

Accordingly, as shown by FIG. 5, beam 25*c* intersects detector 31 at a point 31*c*, which is much closer to point 31*a* than is point 3l*b*. Thus, the compensating displacement $d_c$ reduces image quality degradation resulting from thermal expansion of the anode. It will be readily apparent that in an ideal arrangement, $d_e$ and $d_c$, which are each on the order of hundreds of microns, will be equal. In such case $\theta_2$ will be zero, and detector intersection points 31*a* and 31*c* will coincide.

Referring further FIG. 4, there is shown slight bending or flexure of mounting members 28. Such action is necessary to enable flexure of anode plate 26 and particularly of the inner plate component 32.

Figure 6:
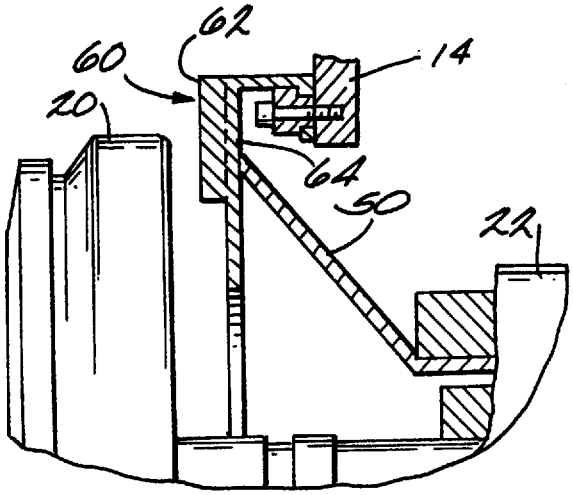
FIG. 6 is a sectional view showing a modification of the invention.

Referring to FIG. 6, there is shown a modification of the invention, wherein an anode plate 60 has been substituted for anode plate 26. Anode plate 60 has an outer plate component 62 and an inner plate component 64, and the dimensions thereof are substantially the same as plate components 30 and 32, respectively. However, anode plate 60 has been formed from a single material such as stainless steel, so that outer and inner plate components 62 and 64 comprise an integral structure. Anode plate 60 responds to heat radiated from the anode, in substantially the same manner described above in connection with anode plate 26, to provide a compensating displacement for anode thermal expansion.

Figure 7:
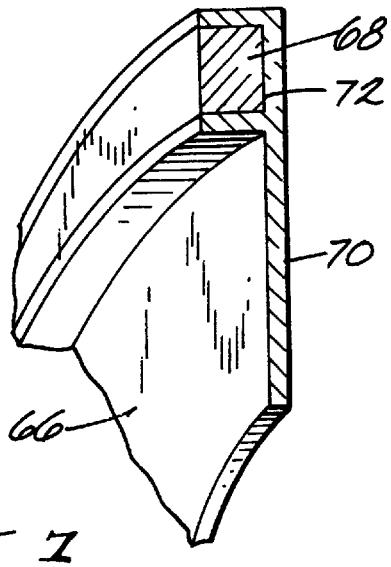
FIG. 7 is a sectional view showing a second modification of the invention.

Referring to FIG. 7, there is shown a section of an annular anode plate 66 comprising a further modification of the invention. More specifically, plate 66 comprises outer plate component 68 and inner plate component 70, which are respectively formed of low and high CTE materials as described above in connection with anode plate 26. However, for plate 66, the outer edge of inner plate component 70 is formed to provide a groove or channel 72, which is sized to receive outer component 68, comprising a ring-shaped member (although only a section thereof is shown in FIG. 6). Outer plate component 68 is secured within channel 72 by any suitable means, such as brazing, press fitting, or tack welding.

Obviously many other modifications and variations of the present invention are possible in light of the above teachings. It is therefore to be understood that within the scope of the disclosed concept, the invention may be practiced otherwise than as has been specifically described.

What is claimed is:

1. In an arrangement comprising an X-ray tube having a housing provided with an X-ray transmissive window, a cathode to project a stream of electrons, and an anode disposed to receive the electron stream at a focal spot to produce X-rays, and further comprising a collimator in fixed relation with said window and having an aperture disposed to receive said X-rays, apparatus for selectively mounting the anode within the housing comprising:

an anode frame disposed to support said anode for rotation about a specified axis;

an anode plate means joined to said anode frame for initially locating said anode so that said focal spot is at a specified position with respect to said aperture, and for displacing said anode, following thermal expansion thereof, along said axis to urge said focal spot back toward said specified position; and plate mounting means for selectively attaching said anode plate means to said housing.

2. The apparatus of claim 1 wherein:

said anode plate means comprises means for displacing said anode in corresponding relationship to an amount of heat radiated to said anode plate means from said anode.

3. The apparatus of claim 1 wherein:

said anode plate means comprises an annular anode plate comprising inner and outer annular plate components, which are joined together so that said outer plate component is proximate to the outer circumference of said inner plate component.

4. The apparatus of claim 3 wherein:

said plate mounting means comprises means for supporting said annular anode plate so that the centroids of said inner and outer plate components are respectively located on said specified axis, in spaced-apart relationship with one another.

5. The apparatus of claim 4 wherein:

said inner and outer plate components each has a thickness dimension lying in the direction of said specified axis, the thickness of said outer plate component being selectively greater than the thickness of said inner plate component so that said inner plate component flexes along said axis in response to said radiated heat.

6. The apparatus of claim 5 wherein:

said plate mounting means comprises a compliant plate mounting structure disposed to attach an outer edge of said annular anode plate to an inner wall of said housing.

7. The apparatus of claim 6 wherein:

said heat generated by said electron stream causes said anode to thermally expand so that said focal spot position is displaced in a first direction along said axis; and said anode frame is fixably joined to said inner plate component so that said anode frame and said anode move along said axis in a direction opposite to said first direction when said inner plate component flexes away therefrom, whereby said focal spot position is likewise urged in said opposite direction to compensate for said focal spot displacement in said first direction.

8. The apparatus of claim 6 wherein:

said outer plate component is formed of a first material having a comparatively low coefficient of thermal expansion, and said inner plate component is formed of a second material having a comparatively high coefficient of thermal expansion.

9. The apparatus of claim 8 wherein:

said first material comprises Kovar, and said second material comprises copper.

10. The apparatus of claim 8 wherein:

said first material comprises Kovar, and said second material comprises stainless steel.

11. The apparatus of claim 6 wherein:

said outer plate component and said inner plate component comprise an integral structure.

12. In an X-ray tube having a housing, a cathode disposed to project a stream of electrons, and an anode disposed to receive the electron stream at a focal spot to produce a beam of X-rays, and wherein a collimator having an aperture disposed to receive the X-ray beam is in fixed spaced-apart relationship with the tube, apparatus comprising:

means for supporting said anode for rotation about a specified axis; and an anode plate means joined to said housing for establishing an initial positional relationship between said focal spot and said aperture and, in response to heat resulting in thermal expansion of said anode, providing relative movement between said focal spot and said aperture along said axis, said relative movement tending to re-establish said positional relationship between said focal spot and said aperture.

13. The apparatus of claim 12 wherein:

said anode plate means comprises an annular anode plate comprising inner and outer annular plate components.

14. The apparatus of claim 13 wherein:

said anode supporting means is joined to said anode plate; and said anode plate is disposed to move said anode and said anode supporting means in a direction opposite to the direction of motion of said focal spot resulting from said anode thermal expansion, in order to re-establish said positional relationship.

* * * * *